US011408600B2

(12) United States Patent
Hou et al.

(10) Patent No.: US 11,408,600 B2
(45) Date of Patent: Aug. 9, 2022

(54) LIGHTING APPARATUS

(71) Applicant: XIAMEN ECO LIGHTING CO. LTD., Xiamen (CN)

(72) Inventors: Shouqiang Hou, Xiamen (CN); Qingguang Zeng, Xiamen (CN); Bin Liu, Xiamen (CN); Xu Wu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/468,488

(22) Filed: Sep. 7, 2021

(65) Prior Publication Data

US 2022/0074580 A1 Mar. 10, 2022

(30) Foreign Application Priority Data

Sep. 7, 2020 (CN) ..... 202021932254.4

(51) Int. Cl.
*F21V 23/00* (2015.01)
*F21V 29/70* (2015.01)
*F21V 23/04* (2006.01)

(52) U.S. Cl.
CPC ..... *F21V 23/007* (2013.01); *F21V 23/04* (2013.01); *F21V 29/70* (2015.01)

(58) Field of Classification Search
CPC ..... F21V 23/007; F21V 23/04; F21V 29/70
See application file for complete search history.

(56) References Cited

U.S. PATENT DOCUMENTS

| | | | | |
|---|---|---|---|---|
| 10,323,806 | B1 * | 6/2019 | Li | F21S 8/026 |
| 2007/0041220 | A1 * | 2/2007 | Lynch | F21V 29/75 362/240 |
| 2019/0049080 | A1 * | 2/2019 | Danesh | F21V 15/01 |
| 2019/0203893 | A1 * | 7/2019 | Ye | F21V 23/007 |
| 2021/0071833 | A1 * | 3/2021 | Hou | F21V 23/008 |

FOREIGN PATENT DOCUMENTS

CN 211952279 U * 11/2020

* cited by examiner

*Primary Examiner* — Rajarshi Chakraborty
*Assistant Examiner* — Glenn D Zimmerman
(74) *Attorney, Agent, or Firm* — Chun-Ming Shih; Lanway IPR Services

(57) ABSTRACT

A lighting apparatus includes a light body, a driver circuit and a driver box. The light body includes a light source and a light housing. The driver circuit is used for converting an external power to a driving current. a driver box. The driver box has an external housing and a driver container. The driver circuit is placed in the driver container. The driver container has a side chamber for selectively installing a manual switch coupled to the driver circuit to change a setting of the driver circuit. The driver container is placed inside the external housing and there is a glue room outside the driver container and inside the external housing. The glue room is selectively added with heat dissipation glue for heat dissipation.

20 Claims, 4 Drawing Sheets

LIGHTING APPARATUS

FIELD

The present invention is related to a lighting apparatus, and more particularly related to a lighting apparatus with a convenient driver box.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

SUMMARY

In some embodiments, a lighting apparatus includes a light body, a driver circuit and a driver box.

The light body includes a light source and a light housing.

The driver circuit is used for converting an external power to a driving current.

The driver box has an external housing and a driver container.

The driver circuit is placed in the driver container.

The driver container has a side chamber for selectively installing a manual switch coupled to the driver circuit to change a setting of the driver circuit.

The driver container is placed inside the external housing and there is a glue room outside the driver container and inside the external housing.

The glue room is selectively added with heat dissipation glue for heat dissipation.

In some embodiments, the external housing is a metal box with four external walls and a flipping cover for defining a box space.

The four external walls define an external top and an external bottom.

The flipping cover is operable to rotate with respect to the external top to expose the box space.

In some embodiments, the driver container has a bottom plate and a top unit.

The top unit has a top plate and multiple container walls defining the side chamber and a main chamber.

The top unit and the bottom plate are two separate units.

The bottom plate is placed on the external bottom.

The driver circuit is placed in the main chamber of the driver container.

In some embodiments, the side chamber is located adjacent to the main chamber.

The container walls of the side chamber defines an switch entrance for inserting the manual switch.

In some embodiments, the switch entrance is open facing to the bottom plate.

In some embodiments, one of the container walls of the side chamber has an escape hole for an operation lever of the manual switch to expose on a lateral side of the driver container.

In some embodiments, where the container walls also defines a wiring chamber for inserting an enlarged wiring head of an external wire inserted into the top unit from a wiring entrance.

The wiring entrance and the switch entrance are both open facing to the bottom plate.

In some embodiments, the container wall has multiple connector holes for electrically connecting the manual switch and the enlarged wiring head to the driver circuit.

In some embodiments, the top unit has a side bracket extended from a lateral side of the main chamber.

The side bracket has a bracket bottom plate engaging the external bottom.

In some embodiments, the enlarged wiring head is enclosed by one of the external walls and the side bracket.

In some embodiments, the side bracket has a bracket wall with a larger height than the container walls.

The bracket wall separates the glue room from the wiring chamber.

In some embodiments, the flipping cover has a cover buckle to attach to the external wall for closing the box space.

In some embodiments, there is a fire safety gap between the flipping cover and the top plate of the driver container.

In some embodiments, the external wall has an external wiring hole for inserting an inner wire connecting to the light source.

In some embodiments, a wire pressing plate is used for fixing the inner wire to stay in the glue room.

In some embodiments, the inner wire is connected to a driver connector electrically connected to the driver circuit in the glue room.

In some embodiments, the driver connector is exposed outside the driver container via a driver connector hole.

In some embodiments, a heat dissipation glue is selectively added to the glue room.

In some embodiments, the driver container has a side bracket with a bracket wall defines an operation space separated from the glue room for preventing the added glue entering the operation space.

In some embodiments, a protruding lever of the manual space is moved in the operation space.

DETAILED DESCRIPTION

Figure 4:
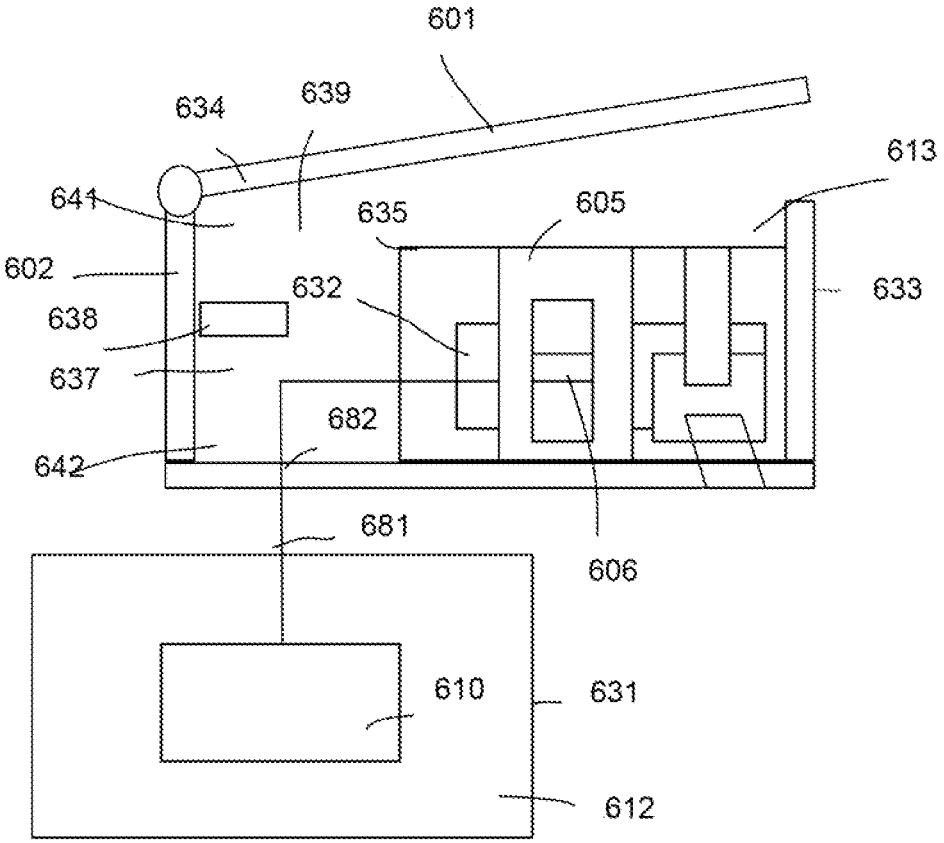
FIG. 4 illustrates another embodiment of a lighting apparatus.

In FIG. 4, a lighting apparatus includes a light body 631, a driver circuit 632 and a driver box 633.

The light body 631 includes a light source 610 and a light housing 612.

The driver circuit 632 is used for converting an external power to a driving current. For example, a 110V AC power is converted by the driver circuit 632 to generate a driving current supplied to the light source 610, which include multiple LED modules. In some embodiments, the multiple LED modules may have different types to mix a required mixed light output and the mixing is controlled by the driver circuit 632.

The driver box 633 has an external housing 634 and a driver container 635.

The driver circuit 632 is placed in the driver container 635. In other words, there are two containers for placing the driver 632, an external container and an internal container. The internal container is placed inside the external container.

The driver container 633 has a side chamber 605 for selectively installing a manual switch 606 coupled to the driver circuit 632 to change a setting of the driver circuit 632.

The driver container 635 is placed inside the external housing 634 and there is a glue room 637 outside the driver container 635 and inside the external housing 634.

The glue room 637 is selectively added with heat dissipation glue 638 for heat dissipation. In other words, the heat dissipation glue is added inside the external housing 634. However, the driver container 635 separates the heat dissipation glue 638 to engage the driver circuit 632 or the manual switch 606.

In some embodiments, the external housing is a metal box with four external walls 602 and a flipping cover 601 for defining a box space 639.

The four external walls 602 define an external top 641 and an external bottom 642.

The flipping cover 601 is operable to rotate with respect to the external top 641 to expose the box space 637.

In some embodiments, the driver container 635 has a bottom plate and a top unit. The components are further illustrated in FIG. 1 to FIG. 3 as follows.

Figure 2:
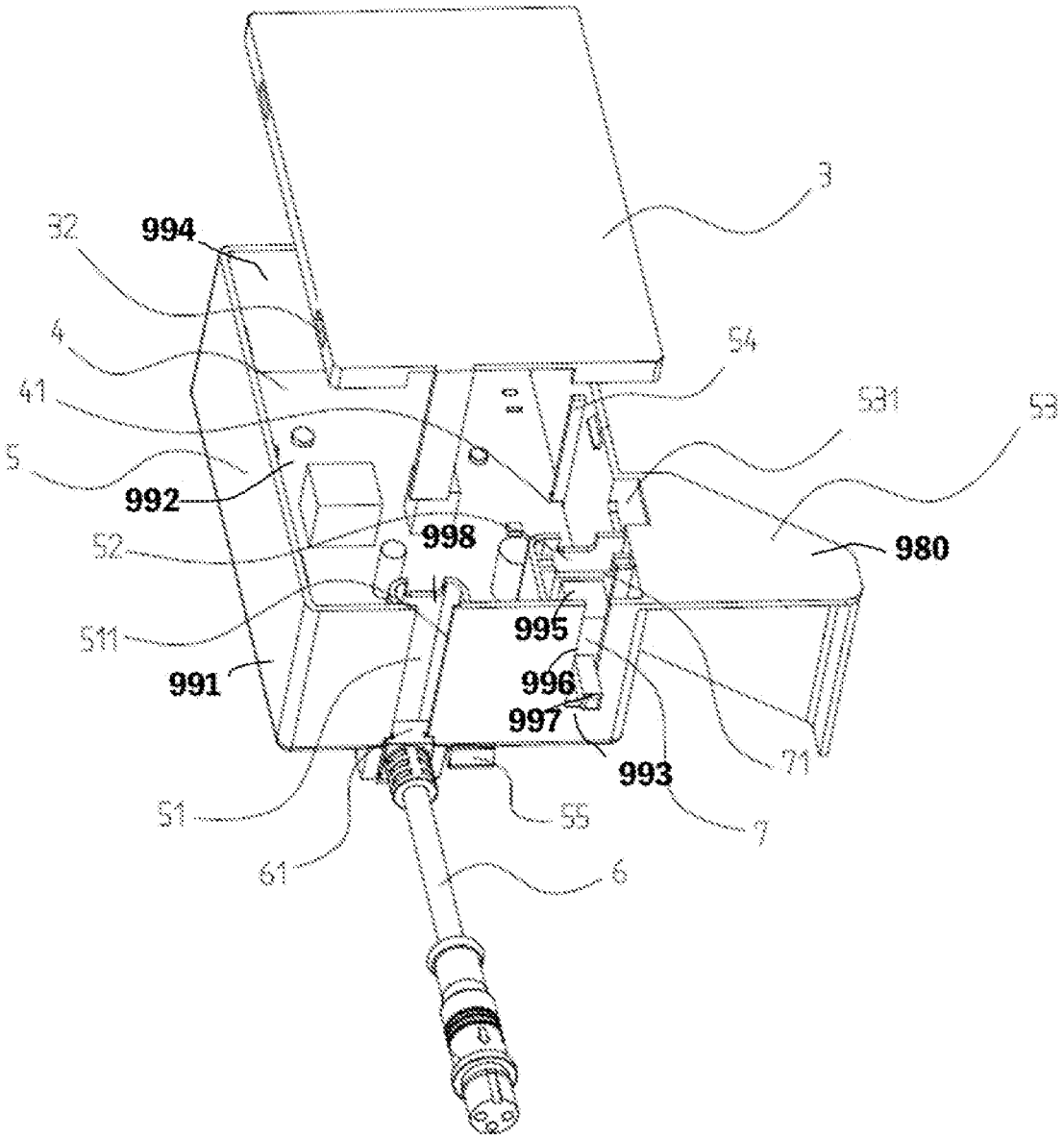
FIG. 2 illustrates an exploded view of the example in FIG. 1.

In FIG. 2, a driver container has a bottom plate 3 and a top unit 991.

The top unit 991 has a top plate 992 and multiple container walls 993 defining the side chamber 71 and a main chamber 994. In other words, there are multiple rooms in the driver container. One room is used for storing the driver circuit. Another room is used for storing the manual switch. The driver circuit is electrically connected to the manual switch via a container hole, e.g. via wire or pins.

The top unit 991 and the bottom plate 3 are two separate units. For example, the top unit and the bottom plate are made of plastic material separately and are combined during assembly. The top unit is detachable from the bottom plate for inserting the driver circuit and other components.

The bottom plate 3 in FIG. 2 is placed on the external bottom 642 in FIG. 4.

The driver circuit 4 is placed in the main chamber 994 of the driver container 5.

In some embodiments, the side chamber 71 is located adjacent to the main chamber 994.

The container walls 993 of the side chamber 71 defines an switch entrance 995 for inserting the manual switch 7.

In some embodiments, the switch entrance 995 is open facing to the bottom plate 3.

In some embodiments, one of the container walls of the side chamber has an escape hole 996 for an operation lever 997 of the manual switch 7 to expose on a lateral side of the driver container 5.

In some embodiments, where the container walls also defines a wiring chamber 51 for inserting an enlarged wiring head 61 of an external wire 6 inserted into the top unit 991 from a wiring entrance 998.

The wiring entrance 998 and the switch entrance 995 are both open facing to the bottom plate 3.

In some embodiments, the container wall 993 has multiple connector holes for electrically connecting the manual switch 7 and the enlarged wiring head 61 to the driver circuit 4.

In some embodiments, the top unit 991 has a side bracket 53 extended from a lateral side of the main chamber 994.

The side bracket 53 has a bracket bottom plate 980 engaging the external bottom.

In some embodiments, the enlarged wiring head 61 is enclosed by one of the external walls and the side bracket 53.

Figure 1:
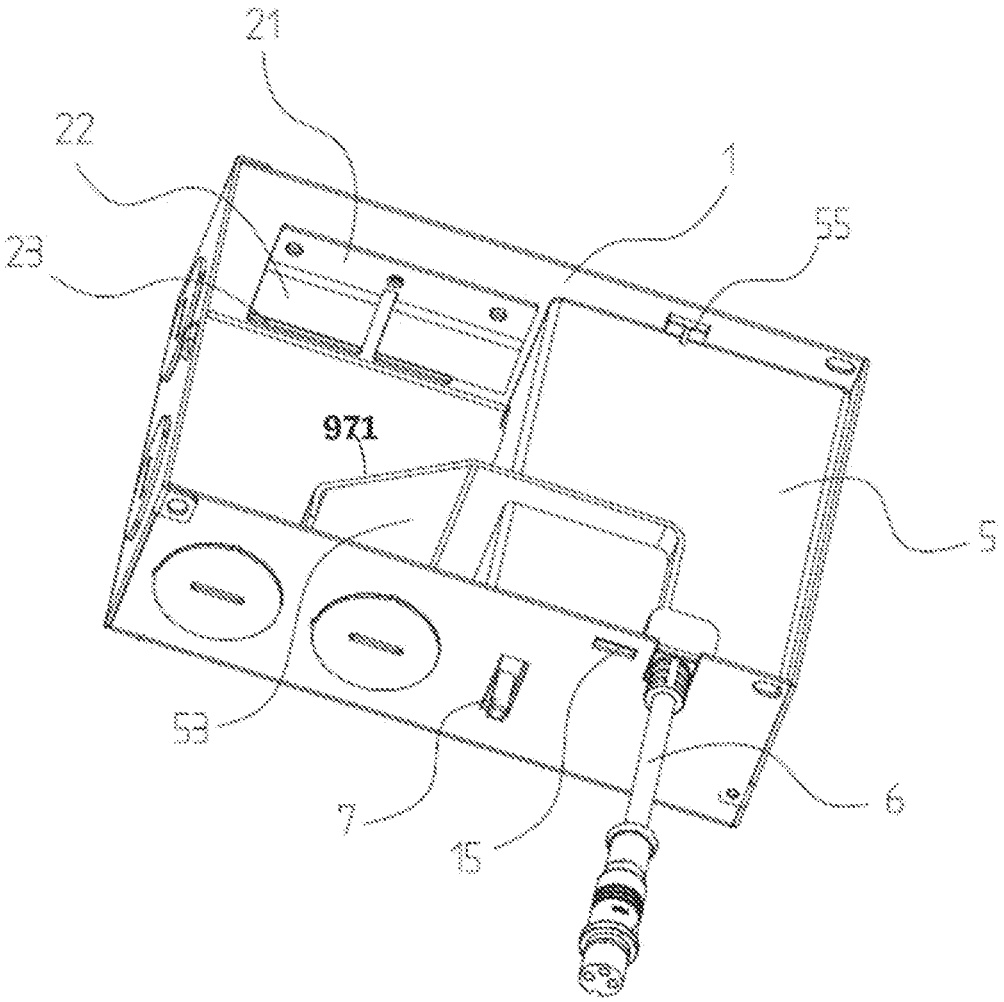
FIG. 1 illustrates a driver box example.

FIG. 1 shows such an arrangement, in which the side bracket 53 separates the glue room from the space of the wiring chamber and the side chamber so that the glue, if added, does not flow into the two chambers.

In FIG. 1, the side bracket 53 has a bracket wall 971 with a larger height than the container walls of the driver container 6.

The bracket wall separates the glue room from the wiring chamber.

Figure 3:
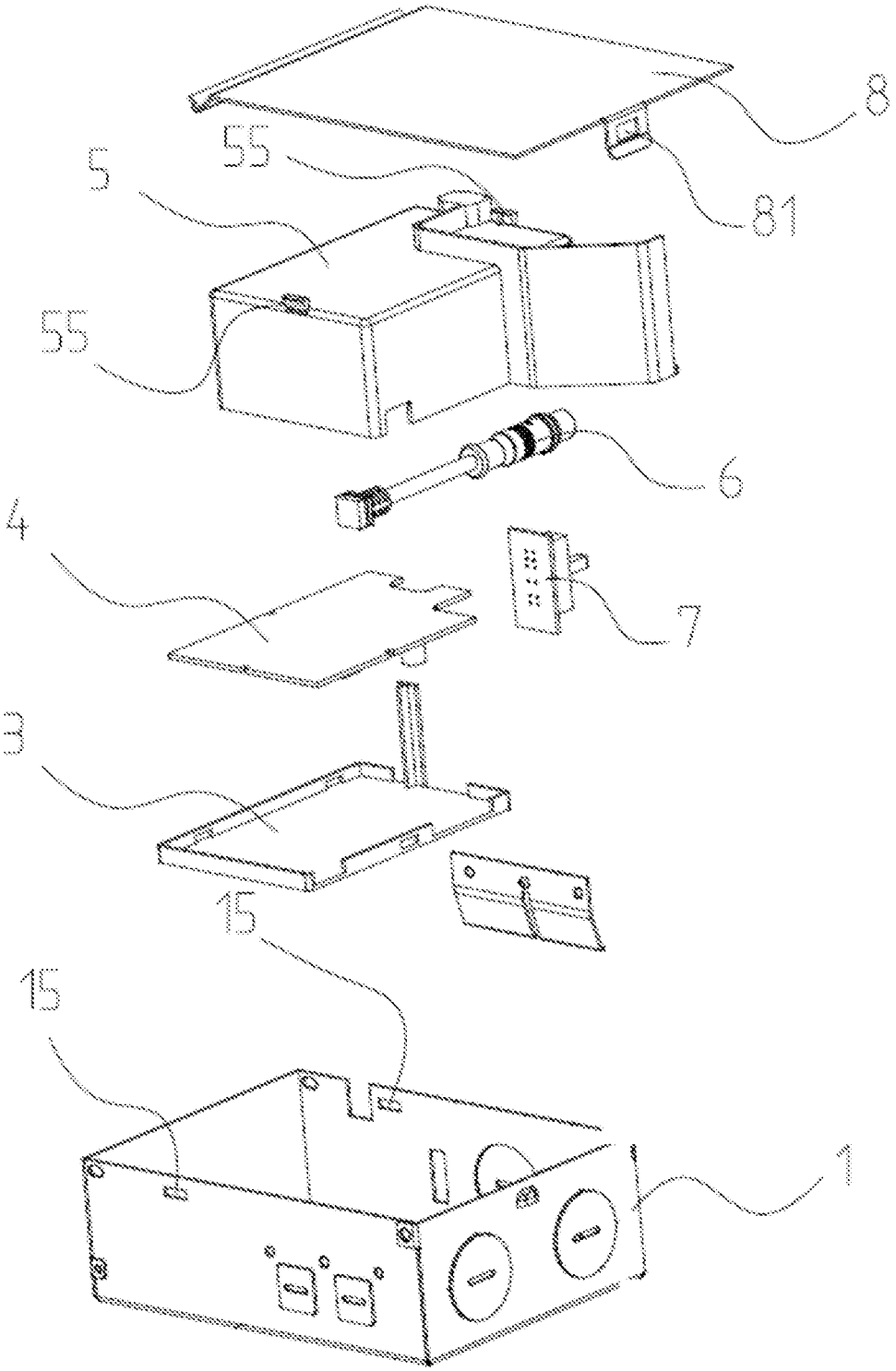
FIG. 3 illustrates another view of the exploded view of FIG. 2.

In FIG. 3, the flipping cover 8 has a cover buckle 81 to attach to the external wall for closing the box space.

In FIG. 4, there is a fire safety gap 613 between the flipping cover 601 and the top plate of the driver container 635.

In FIG. 4, the external wall has an external wiring hole 682 for inserting an inner wire 681 connecting to the light source 610.

In FIG. 1, a wire pressing plate 1 is used for fixing the inner wire to stay in the glue room.

In some embodiments, the inner wire is connected to a driver connector electrically connected to the driver circuit in the glue room.

In some embodiments, the driver connector is exposed outside the driver container via a driver connector hole.

In some embodiments, a heat dissipation glue is selectively added to the glue room.

In some embodiments, the driver container has a side bracket with a bracket wall defines an operation space separated from the glue room for preventing the added glue entering the operation space.

In some embodiments, a protruding lever of the manual space is moved in the operation space.

Please refer to FIG. 1 to FIG. 3, which show a detailed example of a driver box. The same reference numerals refer to the same components among drawings and following description.

In FIG. 1, the driver box has a driver container 5 and an external housing 1. There is a wire pressing plate 2 with a fixed part 21, a movable pressing part 22 and a protection part 23. A protruding bar 66 is used for pressing the driver container 5 to fix to the external housing 1. An external wire 6 is connected to a driver circuit in the driver container 5. A fixing groove 15 is used for positioning and fixing the driver container 5.

There is a manual switch 7 placed on a side of the driver box for operating a setting to determine an operation mode of the driver circuit. There is a side bracket 63 and a wiring hole 17 with a detachable cover to be removed when necessary.

FIG. 2 shows an exploded view of the example in FIG. 1. FIG. 2 further shows a limiting bar 54 and an internal fixing unit 65 for aligning components. There is a container hole 531 for passing a wire. The manual switch 7 has a circuit board 71 to be inserted into the side chamber 52. There are connectors 55 to fix to the external housing. The enlarged wire head 61 is placed in the wiring chamber 61 from an insertion track 511. The top unit 5 is attached to the top plate 3 to close the container space.

There is a limiting groove 41 for aligning the driver circuit 4. Inner fixing holes 32 are used for used for fixing the components.

FIG. 3 shows an exploded view in another view angle of the example in FIG. 2 and FIG. 1.

In FIG. 3, the flipping cover 8 has a cover buckle 81. Other components are mentioned above and not repeated again for brevity.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light body comprising a light source and a light housing;

a driver circuit for converting an external power to a driving current; and a driver box, wherein the driver box has an external housing and a driver container, wherein the driver circuit is placed in the driver container, wherein the driver container has a side chamber for selectively installing a manual switch coupled to the driver circuit to change a setting of the driver circuit, wherein the driver container is placed inside the external housing and there is a glue room outside the driver container and inside the external housing, wherein the glue room is selectively added with heat dissipation glue for heat dissipation.

2. The lighting apparatus of claim 1, wherein the external housing is a metal box with four external walls and a flipping cover for defining a box space, wherein the four external walls define an external top and an external bottom, wherein the flipping cover is operable to rotate with respect to the external top to expose the box space.

3. The lighting apparatus of claim 2, wherein the driver container has a bottom plate and a top unit, wherein the top unit has a top plate and multiple container walls defining the side chamber and a main chamber, wherein the top unit and the bottom plate are two separate units, wherein the bottom plate is placed on the external bottom, wherein the driver circuit is placed in the main chamber of the driver container.

4. The lighting apparatus of claim 3, wherein the side chamber is located adjacent to the main chamber, wherein the container walls of the side chamber defines an switch entrance for inserting the manual switch.

5. The lighting apparatus of claim 4, wherein the switch entrance is open facing to the bottom plate.

6. The lighting apparatus of claim 5, wherein one of the container walls of the side chamber has an escape hole for an operation lever of the manual switch to expose on a lateral side of the driver container.

7. The lighting apparatus of claim 6, where the container walls also defines a wiring chamber for inserting an enlarged wiring head of an external wire inserted into the top unit from a wiring entrance, wherein the wiring entrance and the switch entrance are both open facing to the bottom plate.

8. The lighting apparatus of claim 7, wherein the container wall has multiple connector holes for electrically connecting the manual switch and the enlarged wiring head to the driver circuit.

9. The lighting apparatus of claim 7, wherein the top unit has a side bracket extended from a lateral side of the main chamber, wherein the side bracket has a bracket bottom plate engaging the external bottom.

10. The lighting apparatus of claim 9, wherein the enlarged wiring head is enclosed by one of the external walls and the side bracket.

11. The lighting apparatus of claim 9, wherein the side bracket has a bracket wall with a larger height than the container walls, wherein the bracket wall separates the glue room from the wiring chamber.

12. The lighting apparatus of claim 3, wherein the flipping cover has a cover buckle to attach to the external wall for closing the box space.

13. The lighting apparatus of claim 12, wherein there is a fire safety gap between the flipping cover and the top plate of the driver container.

14. The lighting apparatus of claim 2, wherein the external wall has an external wiring hole for inserting an inner wire connecting to the light source.

15. The lighting apparatus of claim 14, wherein a wire pressing plate is used for fixing the inner wire to stay in the glue room.

16. The lighting apparatus of claim 15, wherein the inner wire is connected to a driver connector electrically connected to the driver circuit in the glue room.

17. The lighting apparatus of claim 16, wherein the driver connector is exposed outside the driver container via a driver connector hole.

18. The lighting apparatus of claim 1, wherein a heat dissipation glue is selectively added to the glue room.

19. The lighting apparatus of claim 18, wherein the driver container has a side bracket with a bracket wall defines an operation space separated from the glue room for preventing the added glue entering the operation space.

20. The lighting apparatus of claim 19, wherein a protruding lever of the manual space is moved in the operation space.

* * * * *